US007638953B2

(12) United States Patent
Denville

(10) Patent No.: US 7,638,953 B2
(45) Date of Patent: Dec. 29, 2009

(54) LIGHTING CONTROL

(75) Inventor: Nicholas Mathew Denville, Mascot (AU)

(73) Assignee: Jands Pty Ltd (AU)

( * ) Notice: Subject to any disclaimer, the term of this patent is extended or adjusted under 35 U.S.C. 154(b) by 0 days.

(21) Appl. No.: 11/573,891

(22) PCT Filed: Aug. 17, 2005

(86) PCT No.: PCT/AU2005/001225

§ 371 (c)(1),
(2), (4) Date: Sep. 4, 2007

(87) PCT Pub. No.: WO2006/017890

PCT Pub. Date: Feb. 23, 2006

(65) Prior Publication Data

US 2008/0048585 A1 Feb. 28, 2008

(30) Foreign Application Priority Data

Aug. 17, 2004 (AU) ..... 2004904656

(51) Int. Cl.
*H05B 37/02* (2006.01)

(52) U.S. Cl. ..... 315/291; 315/294; 315/308; 315/312; 362/227; 362/324

(58) Field of Classification Search ..... 315/294, 315/299, 308, 312; 362/227, 234, 236, 238, 362/552

See application file for complete search history.

(56) References Cited

U.S. PATENT DOCUMENTS

| | | | | |
|---|---|---|---|---|
| 4,947,302 | A | 8/1990 | Callahan | |
| 6,218,787 | B1 * | 4/2001 | Murcko et al. | 315/194 |
| 7,145,125 | B2 * | 12/2006 | May et al. | 250/228 |
| 2004/0017164 | A1 | 1/2004 | Belliveau | |
| 2005/0161586 | A1 * | 7/2005 | Rains et al. | 250/214.1 |
| 2007/0206375 | A1 * | 9/2007 | Piepgras et al. | 362/147 |

FOREIGN PATENT DOCUMENTS

| | | | |
|---|---|---|---|
| EP | 0534710 | A1 | 4/1994 |
| WO | 94/08437 | A1 | 4/1994 |
| WO | 01/05195 | A1 | 1/2001 |
| WO | 02/11497 | A1 | 2/2002 |

* cited by examiner

*Primary Examiner*—David Hung Vu
*Assistant Examiner*—Tung X Le
(74) *Attorney, Agent, or Firm*—Brooks Kushman P.C.

(57) ABSTRACT

A method of applying realtime effects to at least one lighting channel (15) for a lighting fixture or luminaire (11) is disclosed. The method includes the steps of providing a common control means interface (12) which controls the different realtime effects (13/14) to be applied to the one or more lighting channels. The realtime effects include those selected from amongst the following effects: Intensity, Position, Color, Gobo (Pattern) Beam or other controllable attribute of an automated lighting fixture. The method of applying realtime effects making up the combined effect under realtime control is such that each included effects feature of all fixtures is coordinated by a corresponding effects master controller (13/145) for that effect.

12 Claims, 1 Drawing Sheet

LIGHTING CONTROL

This invention relates to lighting consoles and, in particular, to realtime effects for lighting consoles provided by a common entity that relates to each light whose control channel attributes are being modulated.

BACKGROUND OF THE INVENTION

Generally lighting consoles which are used to control lighting systems in theatrical settings or other venues can provide realtime effects which is the ability to modulate control channel attributes with low-frequency realtime waveforms to achieve dynamic looks without having to program a sequence of lighting cues. Generally a static lighting look is established in a single cue and the realtime component is overlayed onto each control channel to a depth controlled by an amplitude parameter. The current state of the art adds a set of realtime attributes to each control channel to affect how the modulation is applied. The set of extra attributes are attributes such as:

- waveshape: e.g. sine, cosine, square, sawtooth, pyramid, etc,
- frequency (rate): cycles of the waveshape which are iterated per second,
- amplitude: the depth of modulation, ie how much of the realtime component is added to the underlying static value,
- offset: a phase offset from a notional base value which allows individual channels to be modulated by different points along the waveshape at the same instant in time.

In prior art systems, as an example, to achieve a circle effect the pan channel can have a sine wave overlayed and the tilt channel can have a cosine wave overlayed. Provided that both channels have the same rate and same amplitude, the two signals combine to make the light describe a circle around the original centre point (the centre point being the static base look before modulation is applied). To take this further: if there were 10 light fixtures all aiming at the same centre point and with the same waveshape rate and amplitude attributes, they could be made to all follow the same point along the circle by keeping their offset attributes identical. If the desired look was for the points to be spread out along the circle, each individual light could adjust the offset values of the pan & tilt channels by an individual amount; e.g. #1 has 0% offset (for both pan & tilt), #2 has 10% offset, #3 has 20% offset and so on.

Sequencing type effects such as intensity or shutter chases can also be achieved using this technology but only to a limited degree. For example, to achieve an intensity chase on a set of 8 lights, a square waveform with a 1:8 mark:space ratio needs to be provided by the implementation. This waveform is applied to the intensity channel of each light and each is assigned an offset value spaced apart by 16.6%. If the requirement is for a chase over 11 lights or over 7 lights then an appropriate and specific waveshape needs to be available for this purpose (with suitable mark:space ratios, e.g. 1:11 or 1:7).

Fundamentally the limitations with the existing state of the art stem from the fact that each modulating attribute exists in complete isolation from other attributes which together combine to achieve the desired look. It is up to the user interface to try and set up the attribute values in such a way so that the synchronization is established that results in the desired effect.

OBJECT OF THE INVENTION

The present invention has therefore been conceived out of the need to provide a system of applying realtime effects which can be applied to a lighting channel, the effects being applied in synchronization by a single controller provided by a common entity that relates to the light(s) whose attribute(s) are being modulated. At the very least, the invention provides an alternative to presently known lighting control systems.

DISCLOSURE OF THE INVENTION

According to the present invention there is provided a method of applying realtime effects to at least one lighting channel, said method including the steps of providing a common control means interface which controls the different realtime effects to be applied to the one or more lighting channels.

Whilst the preferred form of the invention describes the control of Intensity and Position in combination, the invention in the broadest form is not limited thereto and any other combination of parameters including Intensity and Position as well as Color, Gobo (Pattern) Beam or other attribute of an automated lighting fixture may also be controlled as required.

For example, it is common for light fixtures or luminaires to have combined intensity and position effect applied thereto. In a preferred form of the invention, each light has intensity and position under realtime control whereby all the intensity features of all fixtures are coordinated by an intensity effect master controller and all positions of all fixtures are coordinated by a position effect master controller.

The common control means is preferably the grouping of the effect master controllers such that a composite effect is achieved. Preferably, a programming interface is used to manipulate particular effect master parameters either in isolation for a specific effect master controller or through the common control means such that the effect is achieved uniformly for the effect master controllers.

Preferably, data relating to each particular effect associated with the control means is able to be stored in an effect library and applied to other sets of lights of any quantity as appropriate.

Preferably, attributes associated with the realtime effects include: overlap, spread, blocking, direction, and ordering.

BRIEF DESCRIPTION OF THE DRAWINGS

One preferred embodiment of the present invention will now be described with reference to the drawings in which.

BEST MODE OF CARRYING OUT THE INVENTION

Figure 1:
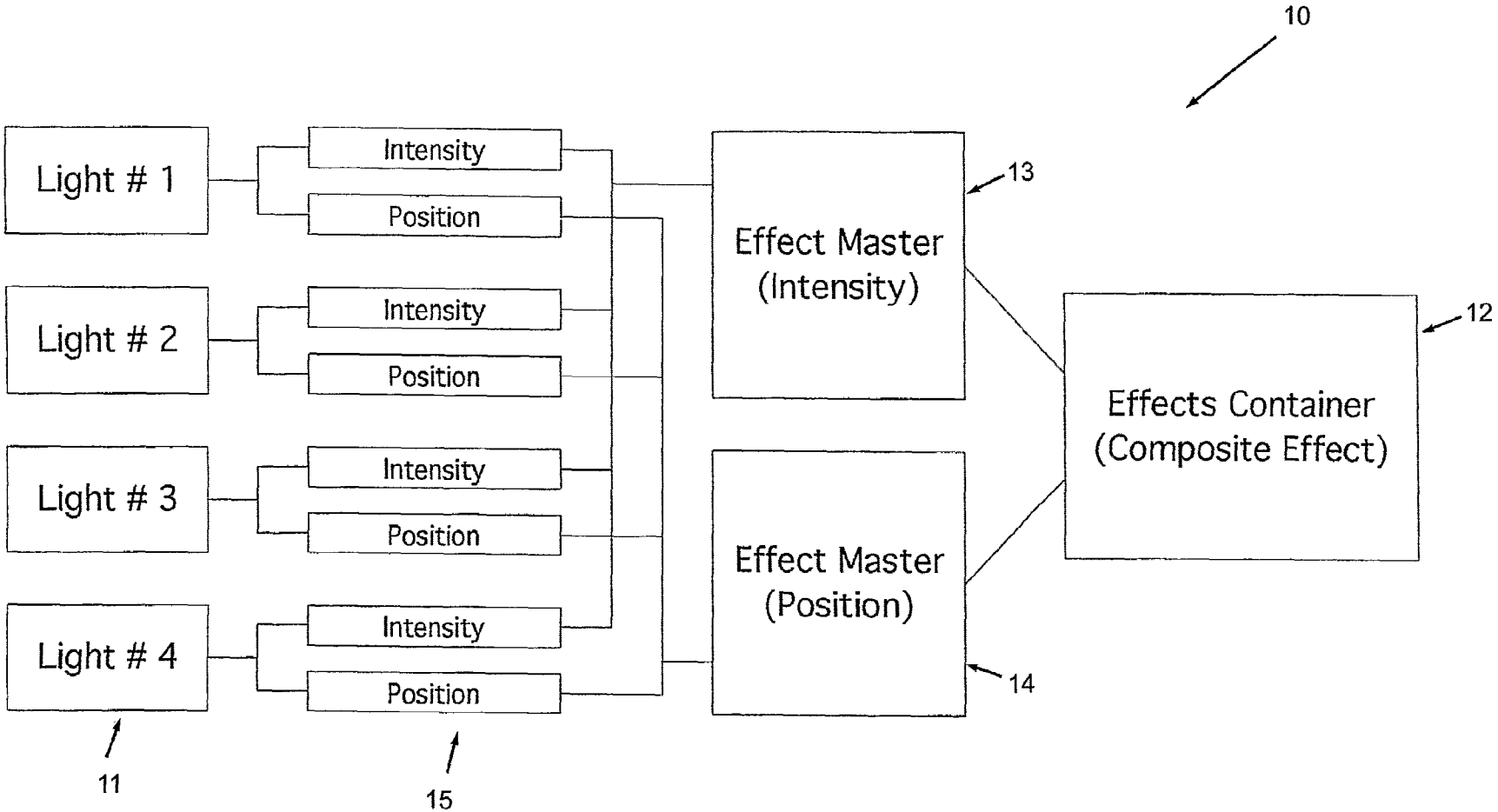
FIG. 1 is a block diagram of a typical lighting control structure of combined intensity and position effects applied to four lights according to a preferred embodiment.

FIG. 1 shows a typical structure of combined intensity and position effect applied to four lights using a preferred embodiment of a lighting control system 10. The system 10 applied to the lights 11 includes a composite effects container 12 which is a grouping of the intensity effect master 13 and the position effect master 14. These masters 13 and 14 apply the effects through intensity and position controllers 15 to the lights 11.

This means that each of the lights 11 has intensity and position under realtime control coordinated by the masters 13 and 14. The programming interface is then able to manipulate particular effect master parameters in isolation for a particular effect from the masters 13 and 14 or through the composite effects container 12 so that a change is achieved uniformly on all the effect masters contained therein.

The effect data that is defined and contained in the effects container 12 are stored in an effect library and can be recovered therefrom and applied at a later date.

The effect masters 13 and 14 in general provide realtime modulations to the various attributes of each of the lights 11. The effect masters effectively controls the lighting attributes by the quantity of lights, the synchronization therebetween and also between the different attributes of each of the lights. The sequence of the realtime effects are also controlled by the masters 13 and 14.

The attributes which are able to be controlled include the following:

Overlap: Overlap controls whether lights perform their modulations simultaneously or whether they perform a cycle of modulation exclusively, one after the other. Overlap consists of a continuous value between 0% and 100% where 100% results in simultaneous modulation and 0% results in fully exclusive sequential modulation. At 50%, for example, each subsequent light would begin a cycle of modulation when its preceding light was halfway through its cycle.

Spread: Spread controls the offset applied to each light depending on the light's position within the whole ordered sequence of lights. Spread varies from 0%, where each light is at the same offset point, to 100%, where the lights are assigned offsets spread evenly (i.e. from 0% offset to 100% offset). At 10% offset, for example, the last light will be 10% ahead of the first light and all intervening lights will be spread evenly (from 0 to 10%).

Blocking: Blocking groups the lights into sets where all lights within the same set get the same offset value. It can be either specified as a whole number (e.g. 3, where lights will be grouped into 3's) or as a percentage ratio (e.g. 25%, where the whole set of lights will be divided up into 4 sets), or as an interval set (e.g. ⅓ where every third light will be grouped.

Direction: Direction controls whether any sequencing happens in the 'up' (first to last), 'down' (last to first) or 'bounce' (first to last to first) orders as the realtime master now has a concept of ordering for the individual lights.

Ordering: Ordering affects how the order of lights is received by the realtime master. 'Original' keeps the lights in their originally programmed order; 'Random' causes the sequence of lights to be shuffled at the start of every full cycle (i.e. when the first light is about to begin it's cycle) and 'Alternate' keeps alternating lights in opposing polarities (e.g. for a ramp-up waveshape, even lights would ramp up and odd lights would ramp down).

The effects masters are also able to provide waveshape attributes since the master now has knowledge of the sequence of lights that are being controlled, there is no longer any need to provide a range of square waves with discrete mark:space ratios. Instead, there is a fundamental set of waveshapes (such as sinusoid, ramp, pyramid, random and rhomboid). A 'phase offset' attribute controls the start & stop point along the waveshape (e.g. a 25% phase offset applied to sinusoid will result in a cosine waveshape). For the square wave there are some dedicated attributes that modify the resultant waveshape: slope affects the slope of the edge of the square, changing it from a square wave (vertical) to a rhomboid (diagonal); Mark/space affects the width of the square/rhomboid (e.g. to affect the flash duration for a shutter chase).

When in use for operation and playback after the programming of the lighting sequence, the organization of the realtime master enables it to adapt dynamically to the quantity of lights that it is applied to, so for example, a single 'intensity chase' effect can be authored that will apply equally effectively to a set of 3 lights or a set of 100.

During playback, most of these attributes can transition linearly so attain seamless transformations from one effect to another, even if the effects are very different (e.g. a spread circle effect transitioning to an alternating can-can).

Multiple realtime masters can be combined together to achieve a composite effect that will be kept perfectly in sync, e.g. an intensity chase can be combined with an up/down position sequence chase so that only the crest of the position wave has intensity. The attributes of the component effects can then be manipulated simultaneously.

The foregoing describes only some embodiments of the present invention and modifications, obvious to those skilled in the art can be made thereto without departing from the scope of the present invention.

The invention claimed is:

1. A method of applying realtime effects to at least one lighting channel for a lighting fixture or luminaire, the effects being applied in synchronization by a single controller provided by a common control means, said method including the steps of providing a common control means interface which controls the more than one different realtime effects to be applied to the one or more lighting channels, and wherein the light fixtures have combined effects applied thereto, each of the effects making up the combined effect being under realtime control whereby each included effects features of all fixtures are coordinated by a corresponding effects master controller for that effect.

2. A method of applying realtime effects according to claim 1, in which the realtime effects include those selected from amongst the following effects: Intensity, Position, Color, Gobo (Pattern) Beam or other controllable attribute of an automated lighting fixture.

3. A method of applying realtime effects according to claim 2, wherein each light fixture or luminaire has intensity and position under realtime control whereby all the intensity features of all fixtures are coordinated by an intensity effect master controller and all positions of all fixtures are coordinated by a position effect master controller.

4. A method of applying realtime effects according to claim 3, in which the common control means is achieved by the grouping of the effect master controllers such that a composite effect is achieved.

5. A method of applying realtime effects according to claim 4, wherein a programming interface is used to manipulate particular effect master parameters either in isolation for a specific effect master controller or through the common control means such that the effect is achieved uniformly for the effect master controllers.

6. A method of applying realtime effects according to claim 5, wherein data relating to each particular effect associated with the control means is able to be stored in an effect library and applied to other sets of lights of any quantity as appropriate.

7. A method of applying realtime effects according to claim 2, wherein the attributes associated with the realtime effects include: overlap, spread, blocking, direction and ordering as defined herein.

8. A method of applying realtime effects according to claim 3, wherein the attributes associated with the realtime effects include: overlap, spread, blocking, direction and ordering as defined herein.

9. A method of applying realtime effects according to claim 4, wherein the attributes associated with the realtime effects include: overlap, spread, blocking, direction and ordering as defined herein.

10. A method of applying realtime effects according to claim 5, wherein the attributes associated with the realtime effects include: overlap, spread, blocking, direction and ordering as defined herein.

11. A method of applying realtime effects according to claim 6, wherein the attributes associated with the realtime effects include: overlap, spread, blocking, direction and ordering as defined herein.

12. A method of applying realtime effects according to claim 1, wherein the attributes associated with the realtime effects include: overlap, spread, blocking, direction, and ordering as defined herein.

* * * * *